US010669760B2

(12) United States Patent
Zetti

(10) Patent No.: US 10,669,760 B2
(45) Date of Patent: Jun. 2, 2020

(54) SNAP-ACTING HINGE WITH DAMPED CLOSURE AND OPENING ANGLE OF MORE THAN 90°

(71) Applicant: D.G.N. S.R.L., Modena (IT)

(72) Inventor: Daniele Zetti, Modena (IT)

(73) Assignee: D.G.N. S.R.L., Modena (IT)

( * ) Notice: Subject to any disclaimer, the term of this patent is extended or adjusted under 35 U.S.C. 154(b) by 0 days.

(21) Appl. No.: 15/785,797

(22) Filed: Oct. 17, 2017

(65) Prior Publication Data

US 2018/0106088 A1 Apr. 19, 2018

(30) Foreign Application Priority Data

Oct. 18, 2016 (IT) ..... 102016000104173

(51) Int. Cl.
*E05D 3/16* (2006.01)
*E05F 1/12* (2006.01)
(Continued)

(52) U.S. Cl.
CPC ..... *E05D 3/16* (2013.01); *E05D 11/105* (2013.01); *E05F 1/1253* (2013.01);
(Continued)

(58) Field of Classification Search
CPC ..... E05D 3/16; E05D 2003/163; E05D 2003/166
See application file for complete search history.

(56) References Cited

U.S. PATENT DOCUMENTS 6,141,832 A * 11/2000 Salice ..... E05D 3/16 16/366
6,243,918 B1 * 6/2001 Zetti ..... E05D 3/16 16/293
(Continued)

FOREIGN PATENT DOCUMENTS

DE 202010015091 U1 2/2012
EP 1736627 A2 12/2006
(Continued)

OTHER PUBLICATIONS

Italian Search Report and Written Opinion dated Jun. 6, 2017 issued in IT 201600104173, with partial translation.

*Primary Examiner* — Jeffrey O'Brien
(74) *Attorney, Agent, or Firm* — Scully, Scott, Murphy & Presser, P.C.

(57) ABSTRACT

A snap-acting hinge with damped closure and opening angle of more than 90°, comprising a first articulated quadrilateral and a second articulated quadrilateral, which have a first lever and a second lever in common and are provided with respective base elements constituted by a plate for coupling to a fixed element and by a plate for fixing to a movable element, the hinge being movable between an open configuration and a closed configuration; the hinge further comprises first elastic elements for holding the open configuration which are associated with the first quadrilateral, second elastic elements for holding the closed configuration which are associated with the second quadrilateral and a damper that acts in the transition from the open configuration to the closed configuration and which is interposed between the first lever and the fixing plate.

13 Claims, 3 Drawing Sheets

(51) Int. Cl.
*E05F 5/10* (2006.01)
*E05D 11/10* (2006.01)
*E05F 5/02* (2006.01)

(52) U.S. Cl.
CPC ..... *E05F 1/1261* (2013.01); *E05F 5/10* (2013.01); *E05D 2003/163* (2013.01); *E05D 2003/166* (2013.01); *E05F 5/02* (2013.01); *E05Y 2900/20* (2013.01)

(56) References Cited

U.S. PATENT DOCUMENTS 6,308,376 B1 * 10/2001 Koshikawa ..... E05D 3/16 16/250
6,374,459 B1 * 4/2002 Zetti ..... E05D 3/16 16/286
6,402,270 B1 * 6/2002 Frank ..... A47F 3/005 16/366
6,568,035 B2 * 5/2003 Zetti ..... E05D 3/16 16/286
7,100,241 B2 * 9/2006 Zetti ..... E05D 3/16 16/283
7,197,790 B1 * 4/2007 Edmondson ..... E05D 3/16 16/286
7,350,273 B1 * 4/2008 Skipper ..... E05D 3/16 16/366
7,543,356 B2 * 6/2009 Zetti ..... E05D 3/16 16/238
7,574,775 B2 * 8/2009 Zetti ..... E05D 3/16 16/266
7,591,046 B2 * 9/2009 Zetti ..... E05D 3/16 16/286
8,225,459 B2 * 7/2012 Waltemate ..... E05D 3/16 16/286
8,656,559 B2 * 2/2014 Hung ..... E05D 3/16 16/286
9,169,681 B2 * 10/2015 Cooper ..... E05D 3/14
9,617,773 B2 * 4/2017 Cooper ..... E05D 3/14
9,803,405 B2 * 10/2017 Zetti ..... E05D 3/16
10,041,283 B2 * 8/2018 Zetti ..... E05F 3/20
10,081,975 B2 * 9/2018 Cooper ..... E05F 5/006
2006/0090296 A1 * 5/2006 Zetti ..... E05D 3/16 16/302
2011/0083299 A1 * 4/2011 Krudener ..... E05D 7/0407 16/319
2011/0154609 A1 * 6/2011 Liao ..... E05D 3/142 16/54
2013/0239363 A1 * 9/2013 apur ..... E05F 5/006 16/50
2015/0218863 A1 * 8/2015 Cooper ..... E05D 3/14 16/235
2015/0337584 A1 * 11/2015 Zetti ..... E05F 3/20 16/65
2017/0306680 A1 * 10/2017 Zetti ..... E05F 3/20

FOREIGN PATENT DOCUMENTS

EP 2909406 A1 8/2015
EP 2947246 A1 11/2015
WO 2014061041 A1 4/2014

* cited by examiner

SNAP-ACTING HINGE WITH DAMPED CLOSURE AND OPENING ANGLE OF MORE THAN 90°

The present invention relates to a snap-acting hinge with damped closure and opening angle of more than 90°.

In the furniture manufacturing sector, in particular for furniture for caravans, camper vans, boats and truck cabs, hinges are known for articulating door leaves for closing spaces about horizontal axes substantially coinciding with their upper side, such as those normally employed in wall cupboards and the like. Such hinges must allow the rotation of the door leaf between a closed configuration, in which it is arranged substantially vertically and is directed downward, and an open configuration, in which it is inclined upward and rotated at an angle of more than 90° with respect to the closed configuration.

These hinges are, substantially, constituted by a first articulated quadrilateral and by a second articulated quadrilateral, which are provided with a first lever and a second lever in common and which have as a base element, respectively, a plate for coupling to a fixed element of an item of furniture that defines a compartment and a plate for fixing to a movable element for closing such compartment. Such hinges are adapted to assume alternately a closed configuration and an open configuration, in which the fixing plate assumes a different arrangement with respect to the coupling plate, in the transition between such configurations the fixing plate performing a rotation angle of more than 90°.

In order to support the weight of the door leaf in the open configuration and in order to ensure the holding of the closed configuration, such hinges must be fitted with two compression springs, one of which is interposed between the first quadrilateral and the coupling plate and the other one between the second quadrilateral and the fixing plate, as described in EP 1,736,627 B1 in the name of the same Applicant.

These conventional snap-acting hinges with an opening angle of more than 90°, however, are not devoid of drawbacks among which is the fact that when being closed the force exerted by the springs causes a sudden rotation of the door leaf connected to the fixing plate, which can then bump into the walls of the compartment of the item of furniture, causing noise, and with the risk that the user could catch his/her fingers, or that materials protruding from the compartment could be damaged.

Also known is a solution of snap-acting hinge with damped closure with an opening angle of 90°, of the type described in EP 2,909,406 A1 in the name of the same Applicant. This hinge has a double-quadrilateral structure with a first lever and a second lever in common, but, with respect to the previous hinge, it has only elastic means that act to hold the open configuration, and which consist of a pair of springs in series, one of which is interposed between the coupling plate and the first lever and the other one between the first and the second lever. In this case the first quadrilateral and the second quadrilateral are dimensioned so that, in the rotation between the open configuration and the closed configuration, the fixing plate performs a rotation angle of 90° with respect to the coupling plate. These snap-acting hinges with damped closure use a damping element interposed between the fixing plate and one of the levers of the second quadrilateral, which is positioned externally to that same quadrilateral, on the opposite side with respect to the first quadrilateral.

However, such damped closure solution cannot be applied to hinges with an opening angle of more than 90° of the type described above, because the space occupation of the spring arranged between the second quadrilateral and the fixing plate does not make it possible to also accommodate the damping element.

The aim of the present invention is to eliminate the above mentioned drawbacks in the background art, by providing a snap-acting hinge with damped closure and opening angle of more than 90° that makes it possible to integrate the holding of both the open configuration and of the closed configuration, as well as the possibility to obtain a damped closure.

Within this aim, an object of the present invention is to not increase the external space occupation compared to conventional snap-acting hinges with opening angle of more than 90°.

Another object of the present invention is to provide a simple structure that is quite easy and practical to implement, safe in use and effective in operation, and low cost.

This aim and these and other objects which will become better apparent hereinafter are all achieved by the present snap-acting hinge with damped closure and opening angle of more than 90°, which comprises a first articulated quadrilateral and a second articulated quadrilateral, which have a first lever and a second lever in common and are provided with respective base elements constituted by a plate for coupling to a fixed element and by a plate for fixing to a movable element, the hinge being movable between an open configuration and a closed configuration, in which the fixing plate has different arrangements with respect to the coupling plate which are angularly spaced apart by an angle of more than 90°, characterized in that it comprises first elastic means for holding the open configuration which are associated with said first quadrilateral, second elastic means for holding the closed configuration which are associated with said second quadrilateral and damping means that act in the transition from the open configuration to the closed configuration and which are interposed between said first lever and said fixing plate.

Further characteristics and advantages of the present invention will become better apparent from the detailed description of a preferred, but not exclusive, embodiment of a snap-acting hinge with damped closure and opening angle of more than 90°, which is illustrated for the purposes of non-limiting example in the accompanying drawings wherein.

Figure 1:
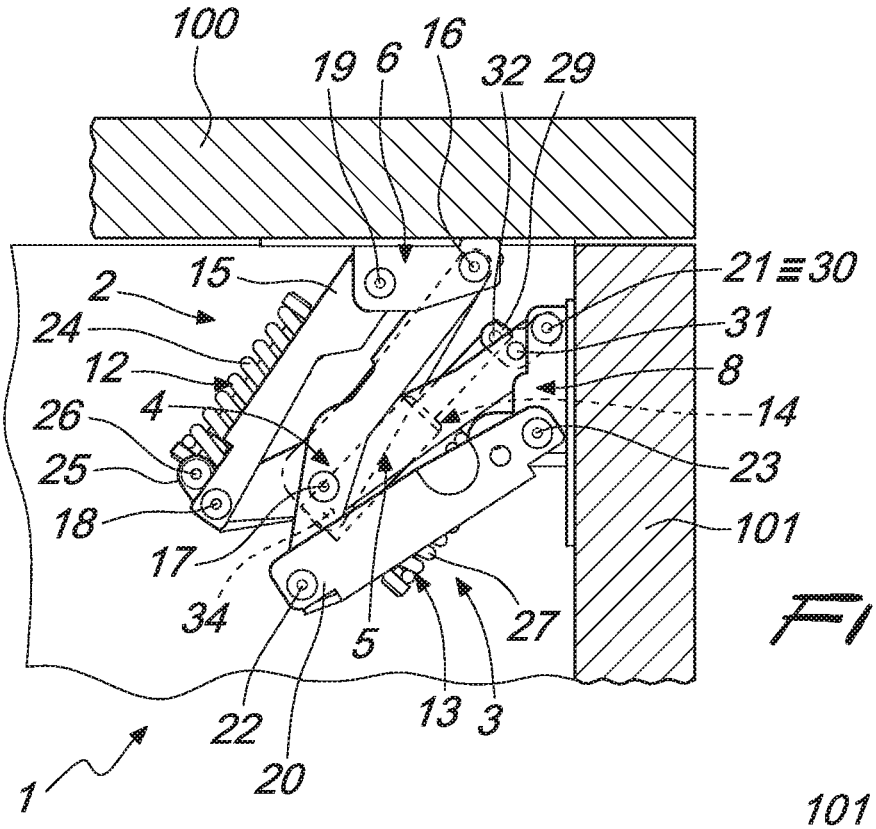
FIG. 1 is a side view of a snap-acting hinge with damped closure and opening angle of more than 90°, according to the invention, in the closed configuration.

With particular reference to the figures, the reference numeral 1 generally designates a snap-acting hinge with damped closure and opening angle of more than 90°.

The hinge 1 comprises a first articulated quadrilateral 2 and a second articulated quadrilateral 3 arranged in series, which have a first lever 4 and a second lever 5 in common and are provided with respective base elements constituted by a plate 6 for coupling to a fixed element 100 and by a plate 8 for fixing to a movable element 101.

When the hinge 1 is used in wall cupboards, for example, the coupling plate 6 is connected in a lower region to the upper element that defines the compartment of the cupboard, and the fixing plate 8 is connected internally to the door leaf that closes the same compartment in a front region. The connection can occur, for example, with conventional screws or other threaded elements.

Figure 2:
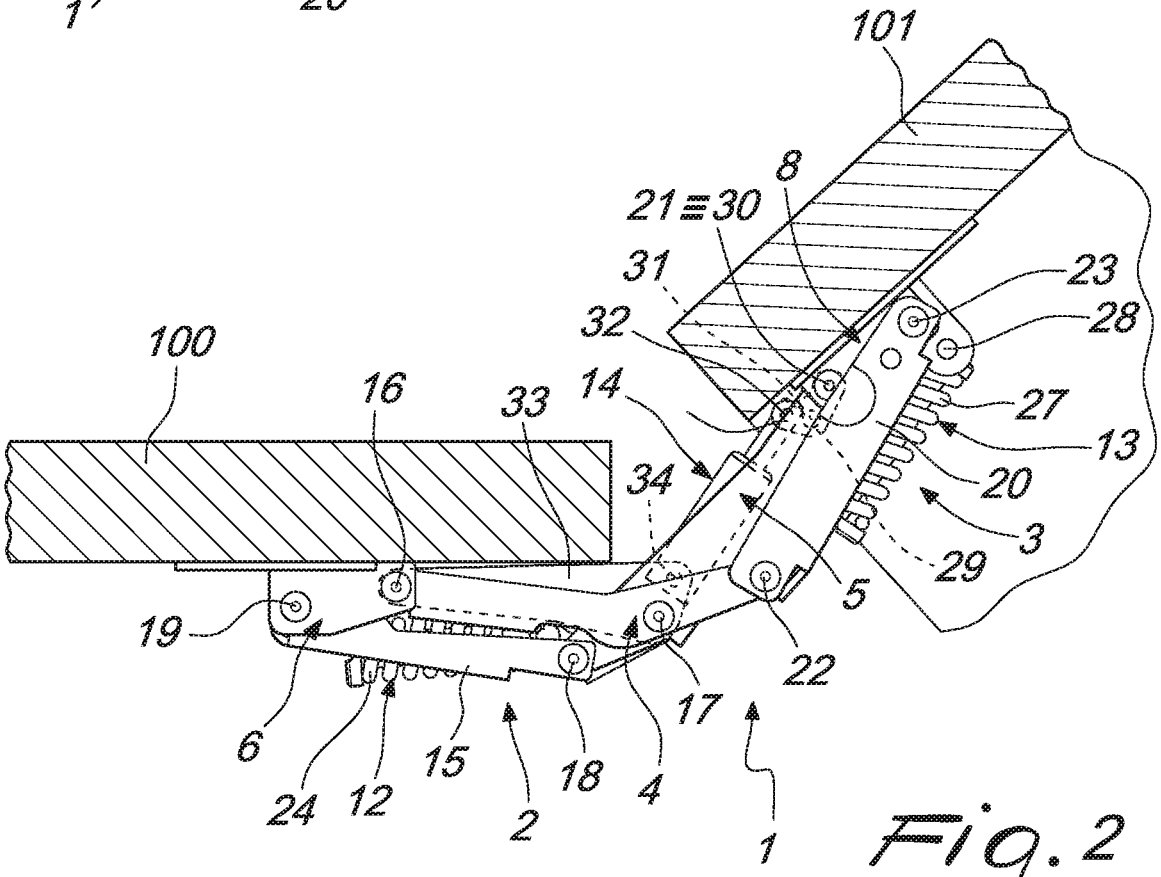
FIG. 2 is a side view of the hinge in FIG. 1 in the open configuration.
Figure 3:
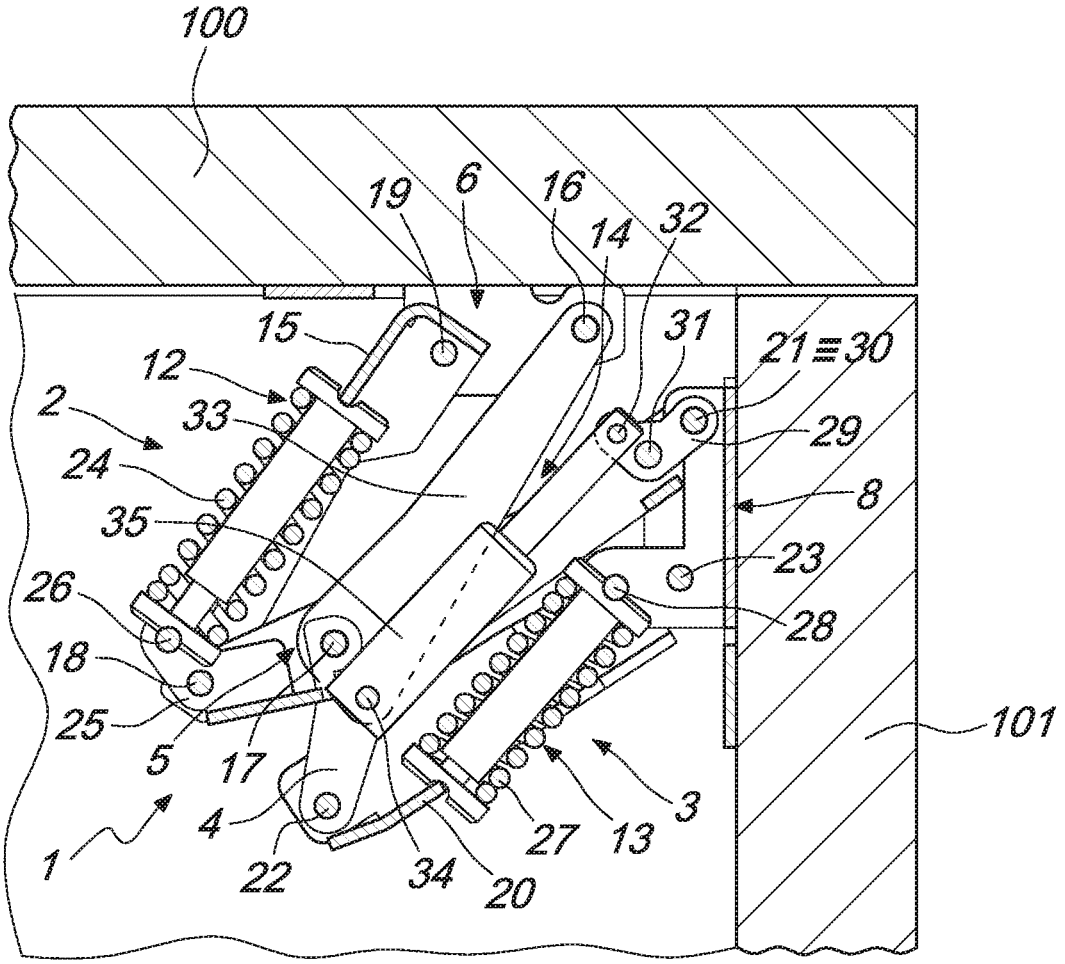
FIG. 3 is a partially cross-sectional view of the hinge in FIG. 1.
Figure 4:
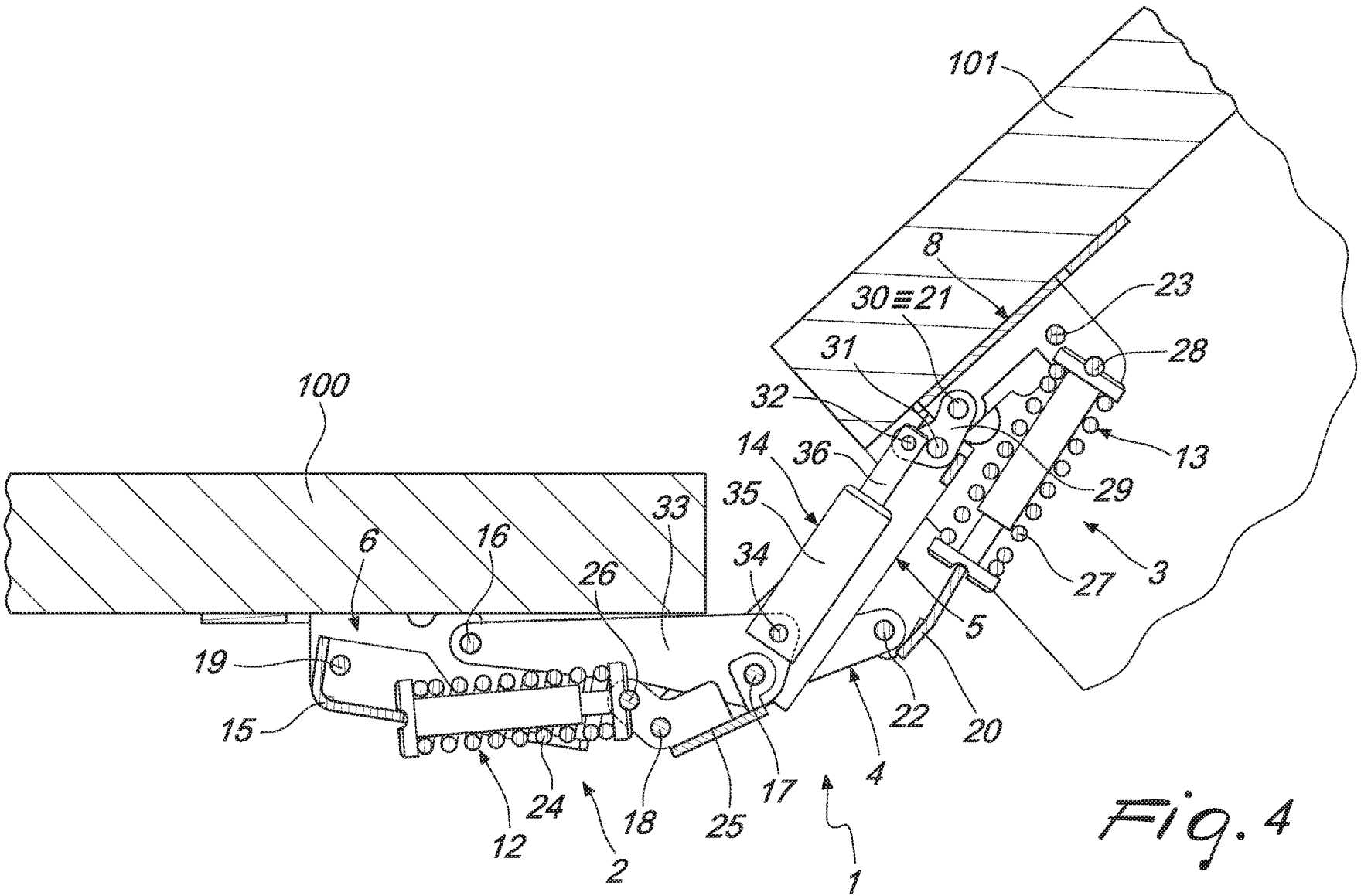
FIG. 4 is a partially cross-sectional view of the hinge in FIG. 2.

In the transition between the closed configuration (FIGS. 1 and 3) and the open configuration (FIGS. 2 and 4) the elements of the hinge 1 rotate about respective horizontal axes, keeping themselves on an ideal vertical plane, and the movable element 101 also rotates about a horizontal axis positioned at the corresponding upper edge.

In the closed configuration and the open configuration, the fixing plate 8 has different arrangements with respect to the coupling plate 6, which are mutually angularly spaced apart by an angle of more than 90°, corresponding to the so-called opening angle of the hinge 1.

The hinge 1 comprises first elastic means 12 for holding the open configuration, which are associated with the first quadrilateral 2, second elastic means 13 for holding the closed configuration, which are associated with the second quadrilateral 3 and damping means 14 that act in the transition from the open configuration to the closed configuration and which are interposed between the first lever 4 and the fixing plate 8.

The first quadrilateral 2 is constituted by the coupling plate 6, by a segment of the first lever 4, by a segment of the second lever 5 and by a first arm 15, which are mutually articulated about respective parallel pivots.

In more detail, in the figures the reference numerals 16, 17, 18 and 19 designate, respectively, the hinging pivot between the coupling plate 6 and the first lever 4, between the first lever 4 and the second lever 5, between the second lever 5 and the first arm 15 and between that first arm and the coupling plate 6.

The second quadrilateral 3 is constituted by the fixing plate 8, by a segment of the second lever 5, by a segment of the first lever 4 and by a second arm 20, which are mutually articulated about respective parallel pivots.

In more detail, in the figures the reference numerals 21, 22 and 23 designate, respectively, the pivot between the fixing plate 8 and the second lever 5, between the first lever 4 and the second arm 20 and between the second arm and the fixing plate 8, the pivot 17 hinging between the first lever and the second lever being common to the first quadrilateral 2.

The first elastic means 12 comprise at least one first compression spring 24 that acts between the first arm 15 and the second lever 5.

In fact, the first arm 15 is substantially U-shaped, being provided with a pair of sides that are connected by a crossmember arranged at the pivot 19, and the first spring 24 is accommodated in the recess defined between the aforementioned sides, resting on the crossmember of that same first arm.

The second lever 5 is integral with a supporting element 25 that is hinged on the pivots 17 and 18 and which supports a pivot 26 that protrudes between the aforementioned sides of the first arm 15, on which the first spring 24 rests in rotation.

The second elastic means 13 comprise at least one second compression spring 27 that acts between the fixing plate 8 and the second arm 20.

The fixing plate 8, in fact, is contoured so as to define a pair of wings that protrude beyond the pivot 23 and support an additional pivot 28, on which the second spring 27 rests in rotation.

Furthermore, the second arm 20 is also substantially U-shaped, being provided with a pair of sides that are connected by a crossmember arranged at the pivot 22, and the second spring 27 is accommodated in the recess defined between the aforementioned sides resting on the crossmember of said second arm.

Furthermore, the hinge 1 comprises at least one bracket 29 for connecting the damping means 14 to the fixing plate 8, which is substantially L-shaped and is constituted by a first portion and by a second portion which are mutually connected.

The first portion of the bracket 29 is hinged to the fixing plate 8 at a first pivot 30 which, preferably, coincides with the pivot 21. Furthermore, the connecting region between the two portions of the bracket 29 is hinged to the second lever 5 about a second pivot 31. Finally, the second portion of the bracket 29 protrudes with respect to the second lever 5 toward the first quadrilateral 2 and carries a third pivot 32 about which the damping means 14 are hinged.

Preferably there are two brackets 29, arranged on mutually opposite sides of the damping means 14 and connected by way of the pivots 30, 31 and 32.

In fact, the second lever 5 is constituted by two parallel wings connected by stiffening bridges, between which the brackets 29 are interposed.

Furthermore, the hinge 1 comprises at least one rod 33 for connecting the damping means 14 to the first lever 4, which is articulated about the pivots 16 and 17 for hinging that first lever, respectively, to the coupling plate 6 and to the second lever 5. The rod 33 comprises a portion that protrudes with respect to the pivot 17 toward the second quadrilateral 3 which carries a fourth pivot 34 about which the damping means 14 are articulated.

Preferably there are two rods 33, arranged on mutually opposite sides of the damping means 14 and mutually connected by way of the pivots 16, 17 and 34.

In fact, the first lever 4 is constituted by two parallel wings connected by stiffening bridges, between which the rods 33 are interposed.

The damping means 14 comprise a piston (not shown in the figures) that can slide within a hollow body 35 and it is associated with a stem 36 that protrudes from that same body.

Preferably, for reasons of space occupation, the stem 36 is hinged to the third pivot 32 and the hollow body 35 is hinged about the fourth pivot 34.

In practice it has been found that the invention as described achieves the intended aim and objects and, in particular, attention is drawn to the fact that the hinge according to the invention makes it possible to integrate, on hinges that have an opening angle of more than 90°, the three functions of holding the open configuration by virtue of the action of the first elastic means, of holding the closed configuration by virtue of the action of the second elastic means, and of damped closure (also known as "soft-close") by virtue of the damping means.

Furthermore, the hinge according to the invention does not present encumbrances outside the quadrilaterals on the side directed toward the user in use.

The invention, thus conceived, is susceptible of numerous modifications and variations, all of which are within the scope of the appended claims.

Moreover, all the details may be substituted by other, technically equivalent elements.

In practice the materials employed, as well as the contingent dimensions and shapes, may be any according to requirements without for this reason departing from the scope of protection claimed herein.

The disclosures in Italian Patent Application No. 102016000104173 (UA2016A007413) from which this application claims priority are incorporated herein by reference.

What is claimed is:

1. A snap-acting hinge with damped closure and opening angle of more than 90°, which comprises a first articulated quadrilateral and a second articulated quadrilateral, the first articulated quadrilateral and the second articulated quadrilateral share a first lever and a second lever and are provided with respective base elements constituted by a coupling plate for coupling to a fixed element and by a fixing plate for fixing to a movable element, the hinge being movable between an open configuration and a closed configuration, further comprising first elastic means for holding the open configuration which are associated with said first quadrilateral, second elastic means for holding the closed configuration which are associated with said second quadrilateral and damping means that act in the transition from the open configuration to the closed configuration and which are interposed between said first lever and said fixing plate, further comprising at least one rod for connecting said damping means to said first lever, which is articulated about a first rod pivot and a second rod pivot for hinging said first lever to said coupling plate and to said second lever and is associated with a fourth pivot for articulating said damping means, wherein the hinge further comprises a second arm of said second quadrilateral, which is adjacent to said second elastic means, and further comprising an arm pivot, wherein the second arm and the first lever are articulated about the arm pivot, wherein in the open configuration, the fourth pivot is nearer the coupling plate than the arm pivot.

2. The hinge according to claim 1, further comprising at least one bracket for connecting said damping means to said fixing plate which is substantially L-shaped and is constituted by a first portion and a second portion which are mutually connected, the first portion being hinged to the fixing plate about a first pivot, the connecting region between said first portion and said second portion being hinged to the second lever about a second pivot and the second portion being hinged to said damping means about a third pivot.

3. The hinge according to claim 2, wherein said third pivot is arranged so as to protrude with respect to said second lever toward said first quadrilateral.

4. The hinge according to claim 2, wherein said first pivot coincides with a first respective pivot for hinging said second lever to said fixing plate.

5. The hinge according to claim 1, wherein said fourth pivot is arranged so as to protrude towards the second quadrilateral with respect to the second rod pivot for hinging said first and second levers.

6. The hinge according to claim 1, wherein said damping means comprise a piston that can slide within a hollow body and is associated with a stem that protrudes from said body.

7. The hinge according to claim 2, wherein a stem that protrudes from said body is hinged about said third pivot and said hollow body is hinged about a fourth pivot.

8. The hinge according to claim 1, wherein said first elastic means comprise at least one first compression spring that acts between said second lever and a first arm of said first quadrilateral which is interposed between said coupling plate and said second lever.

9. The hinge according to claim 1, wherein said second elastic means acts between said fixing plate and the second arm of said second quadrilateral.

10. The hinge according to claim 1, wherein a stem that protrudes from said body is hinged about said third pivot and said hollow body is hinged about said fourth pivot.

11. The hinge according to claim 6, wherein said stem is hinged about said third pivot and said hollow body is hinged about a fourth pivot.

12. The hinge according to claim 1, wherein the fixing plate forms an imaginary arc, the imaginary arc having a first point when the fixing plate is in the open configuration and a second point when the fixing plate is in the closed configuration, wherein the first point and the second point are spaced apart by an angle of more than 90 degrees.

13. The hinge according to claim 12, wherein in both the open configuration and the closed configuration, a portion of the first lever, a portion of the second lever, and a portion of the damping means are aligned along a vertical axis, the vertical axis orthogonal to a plane of the imaginary arc, the plane passing through the first point and the second point.

* * * * *